US011041629B2

(12) United States Patent
Morandotti et al.

(10) Patent No.: US 11,041,629 B2
(45) Date of Patent: Jun. 22, 2021

(54) SYSTEM AND METHOD FOR FOOD PREPARATION UTILIZING A MULTI-LAYER MODEL

(71) Applicant: WHIRLPOOL CORPORATION, Benton Harbor, MI (US)

(72) Inventors: Alberto Morandotti, Briandronno (IT); Davide Guatta, Brescia (IT)

(73) Assignee: Whirlpool Corporation, Benton Harbor, MI (US)

( * ) Notice: Subject to any disclaimer, the term of this patent is extended or adjusted under 35 U.S.C. 154(b) by 372 days.

(21) Appl. No.: 16/307,106

(22) PCT Filed: Oct. 19, 2016

(86) PCT No.: PCT/US2016/057721
§ 371 (c)(1),
(2) Date: Dec. 4, 2018

(87) PCT Pub. No.: WO2018/075030
PCT Pub. Date: Apr. 26, 2018

(65) Prior Publication Data

US 2019/0086097 A1 Mar. 21, 2019

(51) Int. Cl.

| | |
|---|---|
| ***F24C 1/00*** | (2006.01) |
| ***F24C 7/02*** | (2006.01) |
| ***F24C 7/00*** | (2006.01) |
| ***A21B 1/02*** | (2006.01) |
| ***H05B 6/12*** | (2006.01) |

(Continued)

(52) U.S. Cl.
CPC ..... *F24C 7/085* (2013.01); *F24C 1/00* (2013.01); *F24C 1/14* (2013.01); *F24C 7/087* (2013.01); *F24C 15/166* (2013.01)

(58) Field of Classification Search
CPC ..... F24C 1/00–16; F24C 7/00–046; A47J 37/0623; A21B 1/00–22; H05B 6/12–129
See application file for complete search history.

(56) References Cited

U.S. PATENT DOCUMENTS

| | | | |
|---|---|---|---|
| 3,536,129 | A | 10/1970 | White |
| 3,603,241 | A | 9/1971 | Drucker |

(Continued)

FOREIGN PATENT DOCUMENTS

| | | | |
|---|---|---|---|
| CN | 103175237 | A | 6/2013 |
| EP | 0550312 | A2 | 7/1993 |

(Continued)

*Primary Examiner* — Michael A Laflame, Jr.
(74) *Attorney, Agent, or Firm* — Price Heneveld LLP

(57) ABSTRACT

A cooking system is disclosed. The cooking system comprises a controller in communication with a heating apparatus and a user interface. The controller is configured to access a cooking model for a selected food. The cooking model comprises a first layer indicating a first heat absorption relationship and a second layer indicating a second heat absorption relationship. The controller is further configured to receive a first cooking parameter from the user interface for the first layer and a second cooking parameter from the user interface for the second layer. The controller may further calculate a heat exchange model based on the first heat absorption relationship and the second heat absorption relationship.

20 Claims, 5 Drawing Sheets

(51) Int. Cl.

| | |
|---|---|
| ***F24C 7/08*** | (2006.01) |
| ***F24C 1/14*** | (2021.01) |
| ***F24C 15/16*** | (2006.01) |

(56) References Cited

U.S. PATENT DOCUMENTS

| | | | | |
|---|---|---|---|---|
| 3,835,921 | A | 9/1974 | Faris et al. | |
| 4,196,332 | A | 4/1980 | MacKay et al. | |
| 4,210,795 | A | 7/1980 | Lentz | |
| 4,374,319 | A | 2/1983 | Guibert | |
| 4,481,519 | A | 11/1984 | Margerum | |
| 4,777,336 | A | 10/1988 | Asmussen | |
| 4,831,239 | A | 5/1989 | Ueda | |
| 4,868,357 | A | 9/1989 | Serikawa et al. | |
| 4,996,403 | A | 2/1991 | White | |
| 5,008,506 | A | 4/1991 | Asmussen et al. | |
| 5,094,865 | A | 3/1992 | Levinson | |
| 5,293,019 | A | 3/1994 | Lee | |
| 5,360,965 | A | 11/1994 | Ishii et al. | |
| 5,361,681 | A | 11/1994 | Hedstrom et al. | |
| 5,369,253 | A | 11/1994 | Kuwata et al. | |
| 5,389,764 | A | 2/1995 | Nishii et al. | |
| 5,512,736 | A | 4/1996 | Kang et al. | |
| 5,521,360 | A | 5/1996 | Johnson et al. | |
| 5,632,921 | A | 5/1997 | Risman et al. | |
| 5,648,038 | A | 7/1997 | Fathi et al. | |
| 5,681,496 | A | 10/1997 | Brownlow et al. | |
| 5,756,970 | A | 5/1998 | Barger et al. | |
| 5,828,042 | A | 10/1998 | Choi et al. | |
| 5,961,871 | A | 10/1999 | Bible et al. | |
| 6,034,363 | A | 3/2000 | Barmatz et al. | |
| 6,066,838 | A | 5/2000 | Koda et al. | |
| 6,150,645 | A | 11/2000 | Lewis et al. | |
| 6,172,348 | B1 | 1/2001 | Yoshino et al. | |
| 6,455,085 | B1 * | 9/2002 | Duta | A47J 27/16 426/233 |
| 6,559,882 | B1 | 5/2003 | Kerchner | |
| 6,884,979 | B1 | 4/2005 | Torngren et al. | |
| 7,105,787 | B2 | 9/2006 | Clemen, Jr. | |
| 7,111,247 | B2 | 9/2006 | Choi et al. | |
| 7,191,698 | B2 | 3/2007 | Bond et al. | |
| 7,326,888 | B2 | 2/2008 | Chun et al. | |
| 7,461,588 | B2 | 12/2008 | Head | |
| 7,501,608 | B2 | 3/2009 | Hallgren et al. | |
| 7,923,664 | B2 | 4/2011 | Kruempelmann et al. | |
| 7,992,552 | B2 | 8/2011 | Hirano et al. | |
| 8,207,479 | B2 | 6/2012 | Ben-Shmuel et al. | |
| 8,218,402 | B2 | 7/2012 | Lewis et al. | |
| 8,283,605 | B2 | 10/2012 | Arione et al. | |
| 8,324,540 | B2 | 12/2012 | Nordh et al. | |
| 8,330,085 | B2 | 12/2012 | Ishizaki et al. | |
| 8,338,763 | B2 | 12/2012 | Nordh et al. | |
| 8,389,916 | B2 | 3/2013 | Ben-Shmuel et al. | |
| 8,610,038 | B2 | 12/2013 | Hyde et al. | |
| 8,742,305 | B2 | 6/2014 | Simunovic et al. | |
| 8,742,306 | B2 | 6/2014 | Atzmony et al. | |
| 8,839,527 | B2 | 9/2014 | Ben-Shmuel et al. | |
| 8,922,969 | B2 | 12/2014 | Sigalov et al. | |
| 8,927,913 | B2 | 1/2015 | Hyde et al. | |
| 9,035,224 | B2 | 5/2015 | Lim et al. | |
| 9,040,879 | B2 | 5/2015 | Libman et al. | |
| 9,078,298 | B2 | 7/2015 | Ben-Shmuel et al. | |
| 9,131,543 | B2 | 9/2015 | Ben-Shmuel et al. | |
| 9,132,408 | B2 | 9/2015 | Einziger et al. | |
| 9,161,390 | B2 | 10/2015 | Gelbart et al. | |
| 9,161,394 | B2 | 10/2015 | Carlsson et al. | |
| 9,167,633 | B2 | 10/2015 | Ben-Shmuel et al. | |
| 9,210,740 | B2 | 12/2015 | Libman et al. | |
| 9,215,756 | B2 | 12/2015 | Bilchinsky et al. | |
| 9,301,344 | B2 | 3/2016 | Ibragimov et al. | |
| 9,307,583 | B2 | 4/2016 | Sim et al. | |
| 9,332,591 | B2 | 5/2016 | Libman et al. | |
| 9,351,347 | B2 | 5/2016 | Torres et al. | |
| 9,363,852 | B2 | 6/2016 | Carlsson et al. | |
| 9,363,854 | B2 | 6/2016 | Sim et al. | |
| 9,374,852 | B2 | 6/2016 | Bilchinsky et al. | |
| 9,398,644 | B2 | 7/2016 | Okajima | |
| 9,398,646 | B2 | 7/2016 | Nobue et al. | |
| 9,414,444 | B2 | 8/2016 | Libman et al. | |
| 9,459,346 | B2 | 10/2016 | Einziger et al. | |
| 9,462,635 | B2 | 10/2016 | Bilchinsky et al. | |
| 9,462,642 | B2 | 10/2016 | Chu et al. | |
| 2003/0070799 | A1 | 4/2003 | Mueller et al. | |
| 2004/0011074 | A1 * | 1/2004 | Sano | F25D 17/02 62/434 |
| 2006/0191926 | A1 | 8/2006 | Ray et al. | |
| 2008/0105675 | A1 | 5/2008 | Choi et al. | |
| 2008/0297208 | A1 | 12/2008 | Baudin et al. | |
| 2009/0011101 | A1 | 1/2009 | Doherty et al. | |
| 2009/0236333 | A1 | 9/2009 | Ben-Shmuel et al. | |
| 2009/0321428 | A1 | 12/2009 | Hyde et al. | |
| 2010/0059509 | A1 | 3/2010 | Imai et al. | |
| 2010/0176121 | A1 | 7/2010 | Nobue et al. | |
| 2010/0176123 | A1 | 7/2010 | Mihara et al. | |
| 2010/0182136 | A1 | 7/2010 | Pryor | |
| 2010/0187224 | A1 | 7/2010 | Hyde et al. | |
| 2010/0231506 | A1 | 9/2010 | Pryor | |
| 2011/0139773 | A1 | 6/2011 | Fagrell et al. | |
| 2012/0067873 | A1 | 3/2012 | Mihara et al. | |
| 2012/0103972 | A1 | 5/2012 | Okajima | |
| 2012/0168645 | A1 | 7/2012 | Atzmony et al. | |
| 2012/0312801 | A1 | 12/2012 | Bilchinsky et al. | |
| 2013/0048881 | A1 | 2/2013 | Einziger et al. | |
| 2013/0056460 | A1 | 3/2013 | Ben-Shmuel et al. | |
| 2013/0080098 | A1 | 3/2013 | Hadad et al. | |
| 2013/0092145 | A1 | 4/2013 | Murphy et al. | |
| 2013/0142923 | A1 | 6/2013 | Torres et al. | |
| 2013/0146590 | A1 | 6/2013 | Einziger et al. | |
| 2013/0186887 | A1 | 7/2013 | Hallgren et al. | |
| 2013/0206752 | A1 | 8/2013 | Moon et al. | |
| 2013/0240757 | A1 | 9/2013 | Einziger et al. | |
| 2013/0306626 | A1 | 11/2013 | Torres et al. | |
| 2013/0334215 | A1 | 12/2013 | Chen et al. | |
| 2014/0203012 | A1 | 7/2014 | Corona et al. | |
| 2014/0287100 | A1 | 9/2014 | Libman | |
| 2014/0305934 | A1 | 10/2014 | DeCamillis et al. | |
| 2015/0070029 | A1 | 3/2015 | Libman et al. | |
| 2015/0136760 | A1 | 5/2015 | Lima et al. | |
| 2015/0156823 | A1 | 6/2015 | Okajima | |
| 2015/0156827 | A1 | 6/2015 | Ibragimov et al. | |
| 2015/0271877 | A1 | 9/2015 | Johansson | |
| 2015/0346335 | A1 | 12/2015 | Einziger et al. | |
| 2015/0366006 | A1 | 12/2015 | Ben-Shmuel et al. | |
| 2016/0073453 | A1 | 3/2016 | Hyde et al. | |
| 2016/0095171 | A1 | 3/2016 | Chaimov et al. | |
| 2016/0128138 | A1 | 5/2016 | Li et al. | |
| 2016/0205973 | A1 | 7/2016 | An et al. | |
| 2016/0249416 | A1 | 8/2016 | Elboim et al. | |
| 2016/0273970 | A1 | 9/2016 | Alon et al. | |
| 2016/0278170 | A1 | 9/2016 | Atherton et al. | |
| 2016/0323940 | A1 | 11/2016 | Guatta | |
| 2016/0330803 | A1 | 11/2016 | Guatta | |
| 2017/0343220 | A1 * | 11/2017 | Ha | F24C 7/087 |
| 2018/0270918 | A1 * | 9/2018 | Kweon | H05B 6/705 |
| 2020/0085082 | A1 * | 3/2020 | Tran | A23L 3/005 |

FOREIGN PATENT DOCUMENTS

| | | | |
|---|---|---|---|
| EP | 1076475 | A2 | 2/2001 |
| EP | 1193584 | A1 | 3/2002 |
| EP | 1193584 | A1 | 4/2002 |
| EP | 1384951 | A1 | 1/2004 |
| EP | 1471773 | A2 | 10/2004 |
| EP | 1795814 | A2 | 6/2007 |
| EP | 2051564 | A2 | 4/2009 |
| EP | 2512206 | A1 | 10/2012 |
| EP | 2824991 | A1 | 1/2015 |
| EP | 2446703 | B1 | 4/2015 |
| EP | 2446704 | B1 | 4/2015 |
| EP | 2446705 | B1 | 4/2015 |
| EP | 2906021 | A1 | 8/2015 |
| EP | 2916619 | A1 | 9/2015 |
| EP | 2446706 | B1 | 1/2016 |
| EP | 2205043 | B1 | 1/2017 |

(56) References Cited

FOREIGN PATENT DOCUMENTS

| | | | |
|---|---|---|---|
| EP | 2239994 | B1 | 11/2018 |
| FR | 2766272 | A1 | 1/1999 |
| GB | 2193619 | A | 2/1988 |
| RU | 2253193 | C2 | 5/2005 |
| WO | 9107069 | | 5/1991 |
| WO | 9913688 | | 3/1999 |
| WO | 0036880 | | 6/2000 |
| WO | 0223953 | A1 | 3/2002 |
| WO | 2008018466 | A1 | 2/2008 |
| WO | 2010052724 | A2 | 5/2010 |
| WO | 2011058537 | A1 | 5/2011 |
| WO | 2011108016 | A1 | 9/2011 |
| WO | 2011138675 | A2 | 11/2011 |
| WO | 2011138688 | A2 | 11/2011 |
| WO | 2012052894 | A1 | 4/2012 |
| WO | 2012162072 | A1 | 11/2012 |
| WO | 2013078325 | A1 | 5/2013 |
| WO | 2014006510 | A2 | 1/2014 |
| WO | 2014024044 | A1 | 2/2014 |
| WO | 2015099651 | A1 | 7/2015 |
| WO | 2015127999 | A1 | 9/2015 |
| WO | 2016144872 | A1 | 9/2016 |

* cited by examiner

SYSTEM AND METHOD FOR FOOD PREPARATION UTILIZING A MULTI-LAYER MODEL

TECHNOLOGICAL FIELD

The present disclosure generally relates to a cooking system and related methods, and more particularly relates to systems and methods for modeling a food load.

SUMMARY

In at least one aspect, a cooking system is disclosed. The cooking system comprises a controller in communication with a heating apparatus and a user interface. The controller is configured to access a cooking model for a selected food. The cooking model comprises a first layer indicating a first heat absorption relationship and a second layer indicating a second heat absorption relationship. The controller is further configured to receive a first cooking parameter from the user interface for the first layer and a second cooking parameter from the user interface for the second layer. The controller may further calculate a heat exchange model based on the first heat absorption relationship and the second heat absorption relationship.

In at least another aspect, a method for heating a food load is disclosed. The method comprises receiving an indication of a selected food type and accessing a food load model for the selected food type. The model comprises a first layer indicating a first heat absorption relationship and a second layer indicating a second heat absorption relationship. The method may continue by receiving a first input indicating a first cooking parameter of the first layer and a second input indicating a second cooking parameter of the second layer. Based on the first heat absorption relationship and the second heat absorption relationship, the method may continue to calculate a heat exchange model. With the heat exchange model, the method may heat the food load by activating a plurality of heat sources. The heat sources are selectively activated to supply heat according to the heat exchange model thereby heating the food load such that the first layer conforms to the first cooking parameter and the second layer conforms to the second cooking parameter.

In at least another aspect, a cooking system configured heat each of a plurality of layers of a food load to a desired cooking parameter is disclosed. The system comprises a controller in communication with a heating apparatus and a user interface. The controller is configured to receive an indication of a selected food type from the user interface and access a food load model for the selected food type. The model comprises a first layer indicating a first heat absorption relationship, a second layer indicating a second heat absorption relationship, and a third layer indicating a third heat absorption relationship. The controller may further be configured to receive at least one cooking parameter for each of the first layer, the second layer, and the third layer and calculate a heat exchange model based on the cooking parameters. With the heat exchange model, the controller may calculate a cooking routine. The cooking routine may correspond to a control scheme indicating a selective activation of each of a plurality of heat sources to prepare the food load such that each of the first layer, the second layer, and the third layer conform to a corresponding cooking parameter.

These and other features, advantages, and objects of the present device will be further understood and appreciated by those skilled in the art upon studying the following specification, claims, and appended drawings.

DETAILED DESCRIPTION OF EMBODIMENTS

Figure 1:
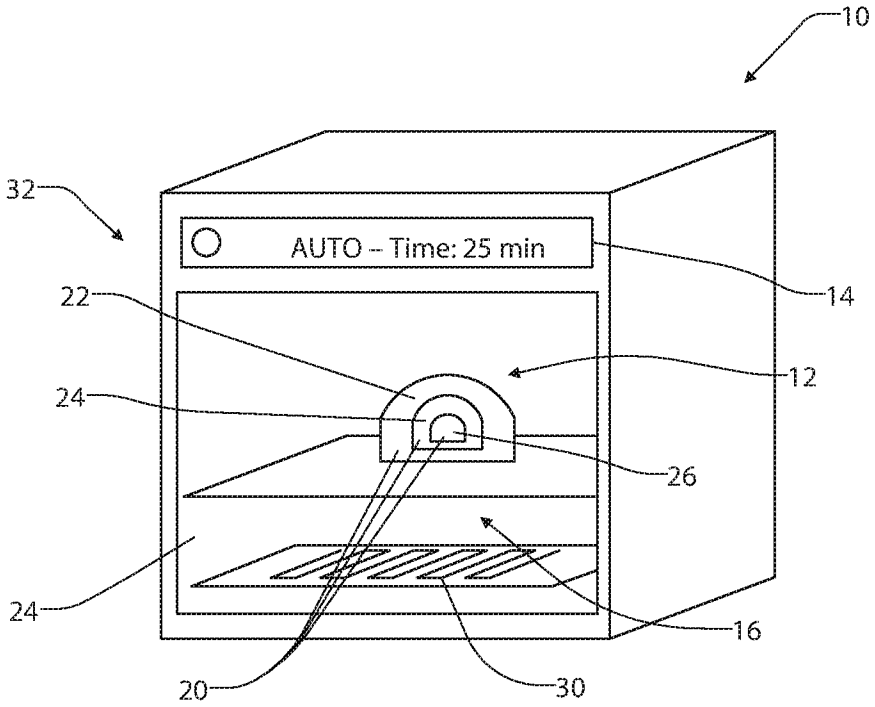
FIG. 1 is a schematic diagram of a cooking system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, the disclosure may provide for a cooking system 10 and method of simulating the preparation of a food load 12. The cooking system 10 may comprise a controller in communication with a user interface 14 and operable to access a model 16 of a food load 12. The model 16 of the food load 12 may comprise a as a plurality of layers 20. For example, the model 16 may comprise a first layer 22 (outside), a second layer 24 (intermediate), and a third layer 26 (interior). Each of the layers 20 may define properties of a food type that may be selected for preparation in a heating cavity 28 of the cooking system 10.

The representation or model 16 of the food load 12 may provide for the estimation of a temperature of each of the layers in response to heat generated by at least one heat source 30 of a heating apparatus 32 of the cooking system 10. In this configuration, the controller may calculate a control scheme for the at least one heat source 30 such that each of the layers 20 of the food load 12 may be prepared by the cooking system 10 to achieve a desired result. Such a result may be preconfigured by a variety of automated functions to control a variety of cooking characteristics of each of the layers 20. Additionally, in some embodiments, the system 10 may provide for a customized setting wherein an operator can select cooking characteristics for each of the layers 20.

The controller of the cooking system 10 may identify material and thermodynamic properties of each of the layers 20 of the food load 12 based on the user selection of the food type. The food type may correspond to a food category (e.g. meats, vegetables, grains, etc.), a food type (chicken, green beans, pasta, etc.), and/or a specific food portion (e.g. chicken breast, baked potato, pizza slice, etc.). Additionally, the controller may be configured to receive or identify a proportion of the food load 12 (e.g. weight, mass, volume, quantity, etc.) and various additional information to indicate a property of the food load 12 such as a starting temperature (e.g. frozen, chilled, room temperature, etc.). Though described as being input by a user, the information describing the food load 12 may also be identified by one or more sensors in communication with the controller (e.g. imagers, light sensors, scales, pressure sensors, and a variety of transducers).

Once the food type and proportion of the food load 12 are identified, the controller may access material properties for each of the layers 20 to simulate the food load 12 as the model 16. Additionally, the controller may scale the model 16 based on the proportion to improve accuracy of a preparation routine for the heat source(s) 30 of the heating apparatus 32. With the material properties of each of the layers 20 as defined by the model 16, the controller may calculate a cooking routine based on an automated program or user defined characteristics of each of the layers 20. The cooking routine may be based on a numerical model description of the food load 12. With the numerical model, the controller may generate and control an actuation strategy of the at least one heat source 30 to prepare each of the layers 20 of the food load to a desired result.

For example, the controller may access a database in a memory or remote server to retrieve the model 16 corresponding to the selected or identified food type. The model 16 may comprise various characteristics of each of the layers 20 of the food load 12. Such characteristics may include, but are not limited to a heat transfer coefficient, density, thermal capacity, thermal diffusivity as well as electromagnetic permittivity, reflection coefficient, IR absorption coefficient, and various additional properties and combinations thereof that may be applied to calculate a response of the food load to the at least one heat source 30 of the cooking device 20. The characteristics of the food load 12 may be included as a numerical model and scaled to describe the food load 12 as a simplified lumped-elements model (e.g. the model 16). Accordingly, the disclosure may provide for a cooking system 10 and related methods of controlling the at least one heat source 30 to prepare each layer 20 of the food load 12 to a desired characteristic, quality, and/or temperature by numerically modeling the layers 20 to account for various heat exchange relationships among the layers 20 and the heating apparatus 32.

The at least one heat source 30 may correspond to one or more of a microwave, convection heater, electrically resistive element, a gas heating element, inductive heating element, infrared element, etc. In operation, the controller of the cooking system 10 may control the at least one heating source 30 to achieve a user defined temperature and/or quality of each of the layers 22, 24, and 26. For example, an operator of the cooking system 10 may want to select specific finishing levels associated with each of the layers 22, 24, and 26. Such finishing levels may include different temperatures, moisture levels, browning levels, consistencies, and/or other various characteristics of each of the layers 20. The temperatures or finishing levels of the layers 20 may be input by an operator of the cooking device 20 via a user interface 14.

Figure 2:
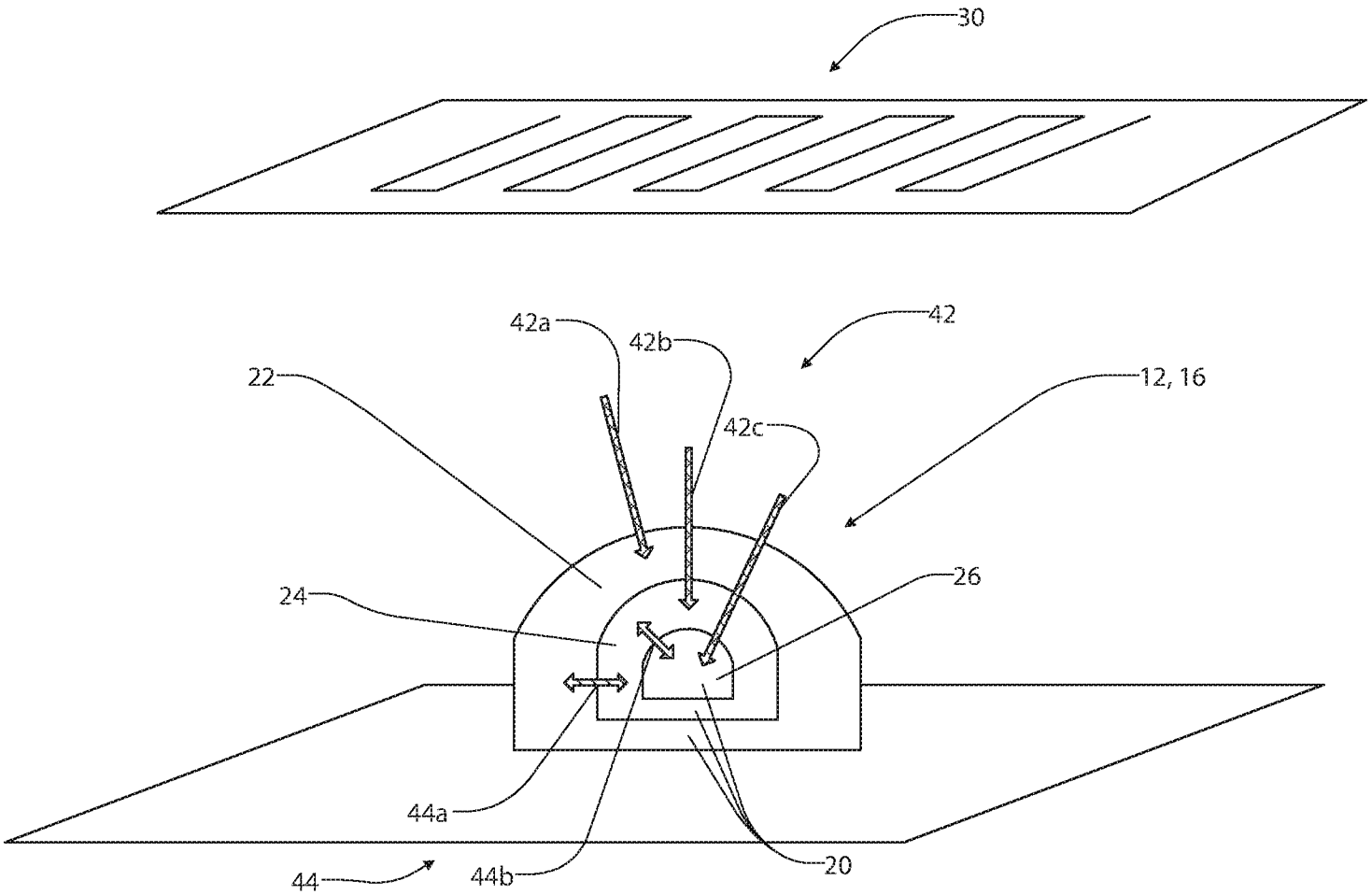
FIG. 2 is a graphical model demonstrating a plurality of layers describing a food load.

Referring now to FIG. 2, the model 16 of the food load 12 is shown demonstrating a relationship of the first layer 22, the second layer 24, and the third layer 26. The model 16 may include a plurality of external heat exchange relationships 42 configured to model the interaction between each of the layers 20 and the at least one heat source 30. Additionally, the model 16 may include a plurality of conductive relationships 44 configured to model the conductive heat transfer between the layers 20. Based on the external heat exchange relationships 42 and the conduction relationships 44, the cooking system 10 may generate a numeric model to simulate the response of each of the layers 20 to heating inputs generated by the at least one heat source 30.

The external heat exchange relationships 42 may be referred to herein as a first external heat exchange relationship 42*a*, a second external heat exchange relationship 42*b*, and a third external heat exchange relationship 42*c*. The first external heat exchange relationship 42*a* may describe an interaction between the at least one heat source 30 and the first layer 22 of the model 16. The second external heat exchange relationship 42*b* may describe an interaction between the at least one heat source 30 and the second layer 24. The third external heat exchange relationship 42*c* may describe an interaction between the at least one heat source 30 and the third layer 26.

The conductive relationships 44 between the layers 20 may be described as a first conductive relationship 44*a* and second conductive relationship 44*b*. The first conductive relationship 44*a* may describe a conductive interaction between the first layer 22 and the second layer 24. The second conductive relationship 44*b* may describe a conductive relationship between the second layer 24 and the third layer 26. In this way, the controller of the cooking system 10 may utilize the model 16 to simulate the behavior of each of the layers 20 based on the external heat relationships 42 and the conductive relationships 44. Additionally, the controller may generate a control scheme for the at least one heat source 30 of the heating apparatus 32 in order to effectuate one or more heating inputs of the relationships 42 and 44.

In some embodiments, the external heat exchange relationships 42 utilized for the model 16 may utilize the first external heat exchange relationship 42*a* and the second external heat exchange relationship 42*b* without the third external heat exchange relationship 42*c*. For example, if the heat source 30 corresponds to a microwave heat source, the microwave energy may only penetrate to approximately less than 2 cm. In some embodiments, the microwave energy may only penetrate to approximately 1 cm. Under such circumstances, the heat generated by the heat source 30 may not penetrate into the third layer 26 and the heat delivered to the third layer may be modeled by the second conductive relationship 44*b*. However, for some processes (e.g. thawing of ice), the third external heat exchange relationship 42*c* may be utilized to model an increased penetration through ice of microwave energy through ice. Accordingly, the model 16 may be adjusted to omit the third external heat exchange relationship 42*c* for specific embodiments or applications of the cooking system 10.

In operation, a selection of a food type may be received by the cooking system 10 via the user interface 14. With the food type selected, the controller may access a specific model (e.g. the model 16) for the selected food type. The model 16 may include each of the layers 20 incorporated in a numeric model. The numeric model may include various food characteristics (e.g. thermal diffusivity, density, thermal capacity, etc.) of the food type. The numeric model therefore may represent each of the external heat exchange relationships 42 and a conductive relationship 44 for the separately modeled layers 20 based on the specific characteristics related to the selected food type. With this information, the controller may calculate a specific heating procedure or routine to selectively activate the at least one heat source 30 over time to reach a desired result as specified by a user or a preconfigured recipe for each of the layers 20.

In an exemplary embodiment, the controller of the cooking system 10 may prompt an operator via the user interface 14 to input one or more desired characteristics of each of the plurality of layers 20. For example, the controller may receive various selections via the user interface 14 to indicate an internal level of doneness or temperature, a level of moisture content or dehydration, a crusting or a brownness level, and/or various properties of each of the layers 20. The level of doneness may also be described utilizing typical cooking terms as they may apply to a selected food type. For example, for a steak the controller may cross-reference the meaning of particular terms (e.g. well done, medium, rare, etc.) for a particular type of meat (e.g. beef, pork, etc.) by cross-referencing the internal temperature for the particular type of meat to achieve the requested result. In this way, the controller may gather information describing a desired result for each of the layers 20 and incorporate the results into the numerical model.

The numerical model may correspond to a lumped sum elements model comprising each of the layers 20 modeled as non-overlapping elements. Thus, the numerical model may be generated based on the model 16 in order to generate the control scheme for the at least one heat source 30. The various embodiments of the cooking system 10 may utilize a numerical representation of the model 16 to control the at least one heat source 30 of the heating apparatus 32 to prepare the food load 12 to meet the desired quality results requested for each of the layers 20. In some embodiments, a plurality of heat sources may be independently activated by the controller to provide various intensities and methods of heat delivery to the food load 12 to provide the desired results for each of the layers 20.

Figure 3A:
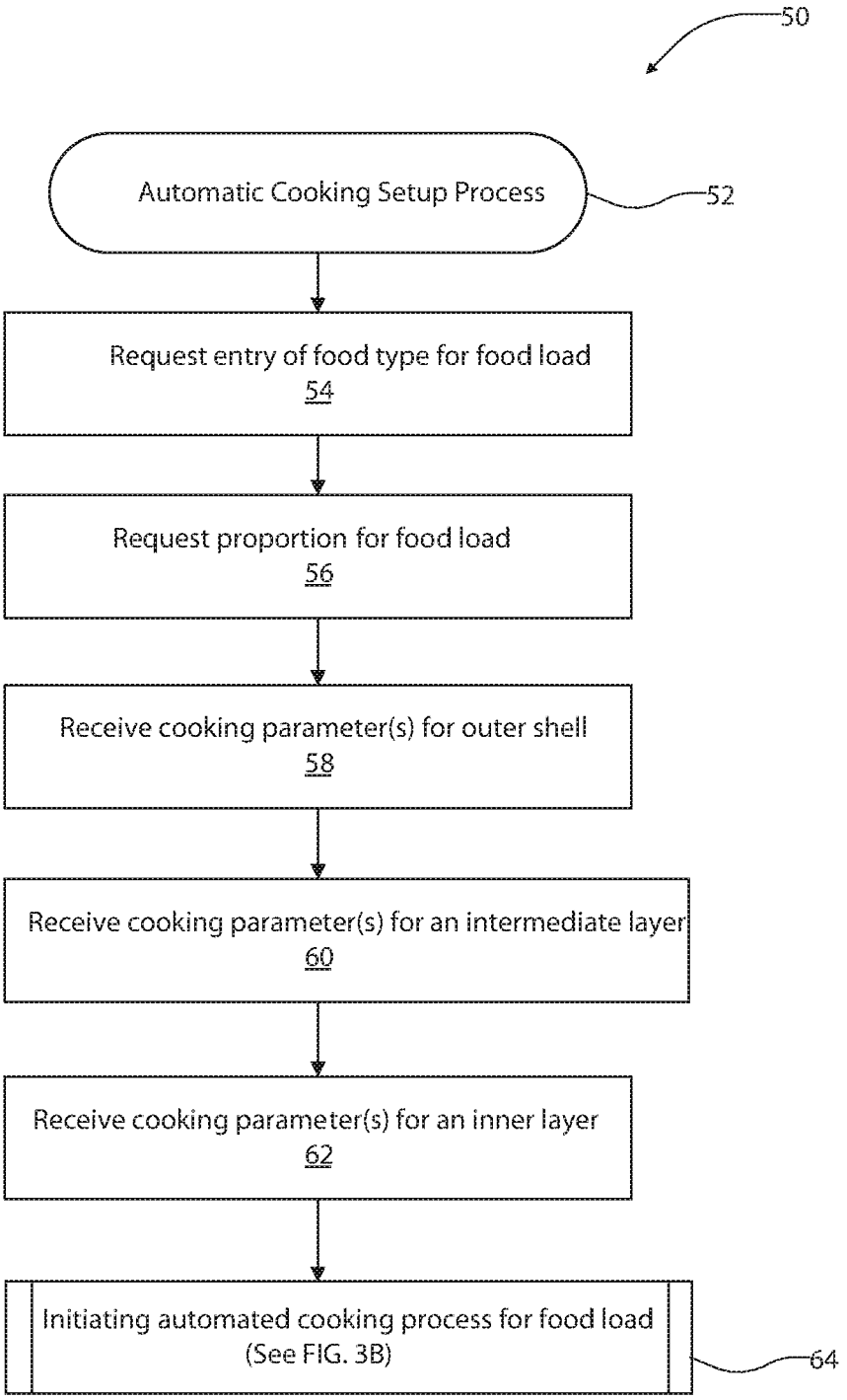
FIG. 3A is a flow chart demonstrating a method of operation of a cooking system.
Figure 3B:
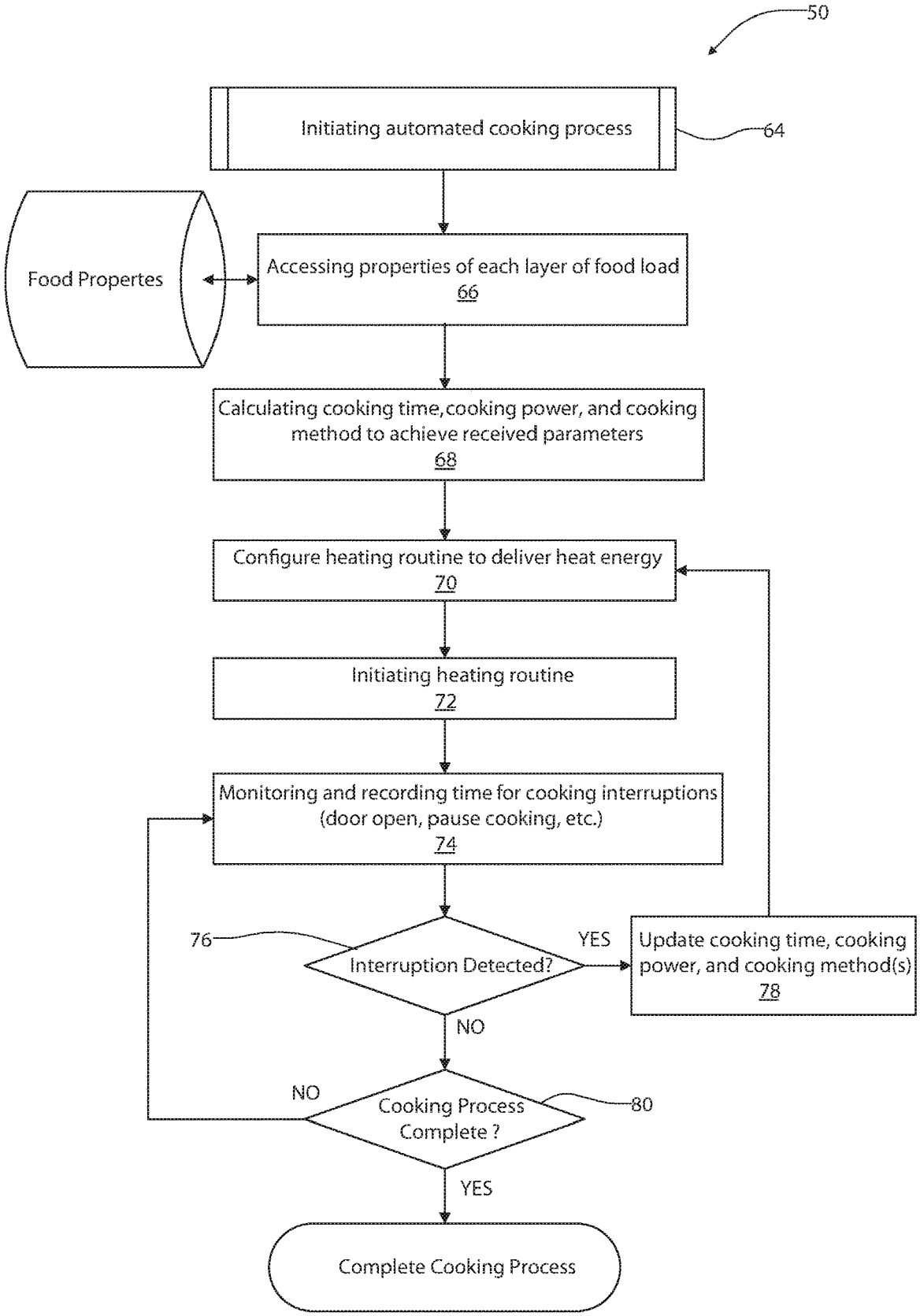
FIG. 3B is a flow chart demonstrating a method of operation of a cooking system continued from FIG. 3A.

Referring now to FIGS. 3A and 3B, a flow chart of a cooking method 50 utilizing the model 16 is shown. The method 50 may begin by initiating a setup for a cooking routine (52). In response to the initiation of the setup for the cooking routine, the controller of the cooking system 10 may request and/or receive an entry of a food type for the food load 12 (54). Additionally, the method 50 may request and/or receive a proportion (e.g. weight, mass, volume, quantity, etc.) for the food load 12 (56). Based on this information, the controller may utilize the food type selected in step 54 to retrieve a model 16 including characteristics of the plurality of layers 20 for the selected food type. Additionally, the controller may scale the model based on the proportion of the food load 12 received in step 56.

With the model 16, the method 50 may continue by receiving a cooking parameter for an outer shell for the first layer 22 of the model 16 (58). The controller may also receive one or more cooking parameters for an intermediate layer for the second layer 24 of model 16 (60). Finally, the controller may receive one or more cooking parameters for an inner layer for the third layer 26 of the model 16 (62). Each of the cooking parameters may be receive via the user interface 14, which may comprise a screen configured to prompt an operator of the cooking system 10 to input the cooking parameters.

Once the one or more parameters are received for each of the layers 20, the controller may initiate an automated cooking process for the food load 12. The automated cooking process may comprise a control routine for the at least heat source 30 to achieve the desired results defined as the cooking parameters for each of the layers 20. Though specifically described as receiving the individual parameters for each of the plurality of layers 20, the cooking system 10 may similarly be configured to automatically provide recipes incorporating parameters for each of the plurality of layers 20. In this way, the cooking system 10 may provide for a balance of flexibility and ease of use to achieve a desired result for each of the layers 20.

Continuing now in reference to FIG. 3B, the method 50 may continue by initiating the automated cooking process (64). As previously described in reference to FIG. 3A, the controller may generate a numerical representation of the model 16 by accessing properties of each of the layers 20 of the food load 12 (66). As further described in reference to FIG. 4, the controller may access the properties for each of the layers 20 via local storage in the form of a memory and/or a communication circuit configured to communicate with a remote server. With the numerical representation of the model 16 populated with the properties of the food type and the desired results of each of the layers 20, the controller may resolve the numerical representation of the model 16 to determine a cooking time, cooking power, and cooking method to achieve the received parameters (68).

Resolving the numerical representation of the model 16 may comprise simulating and generating a cooking routine configured to control the at least one heat source 30 to supply inputs to each of the external heat exchange relationships 42 and the resulting conductive relationships 44. In some embodiments, the at least one heat source 30 may comprise a plurality of heat sources, each of which may be configured to deliver heat energy to the food load 12 via different heat delivery methods. For example, the at least one heat source 30 may correspond to a plurality of heat sources including one or more of a gas burner, an electrically resistive heating element, and induction heating element, a browning or ferritic heating element, a microwave apparatus, or any other suitable heating device. Accordingly, the method 50 may continue to configure or optimize the heating routine utilizing one more heat delivery methods available by controlling the at least one heat source 30 (70). With the heating routine, the method 50 may then continue by controlling the heating apparatus 32 to achieve the heating routine thus providing for the desired results for the layers 20 (72).

During the heating routine, the controller may continue by monitoring the status of the heating apparatus 32 and recording a cooking time to identify cooking interruptions (74). An interruption may include opening a door or access hatch during the heating routine, pausing a cooking operation, etc. In step 76, if an interruption is detected, the method 50 may update a cooking time, cooking power, and various other characteristics of the heating routine (78). Following step 78, the method may return to step 70.

If in step 76 no interruption is detected, the controller may continue to monitor the heating routine to determine if the cooking process is complete (80). If the cooking process is not complete in step 80, the controller may return to step 74 to continue monitoring and recording the operation of the heating apparatus 32 for interruptions. Once the cooking process is identified as being complete, the controller may continue to finish the cooking process, which may include outputting a message or alert to communicate that the process is complete.

Figure 4:
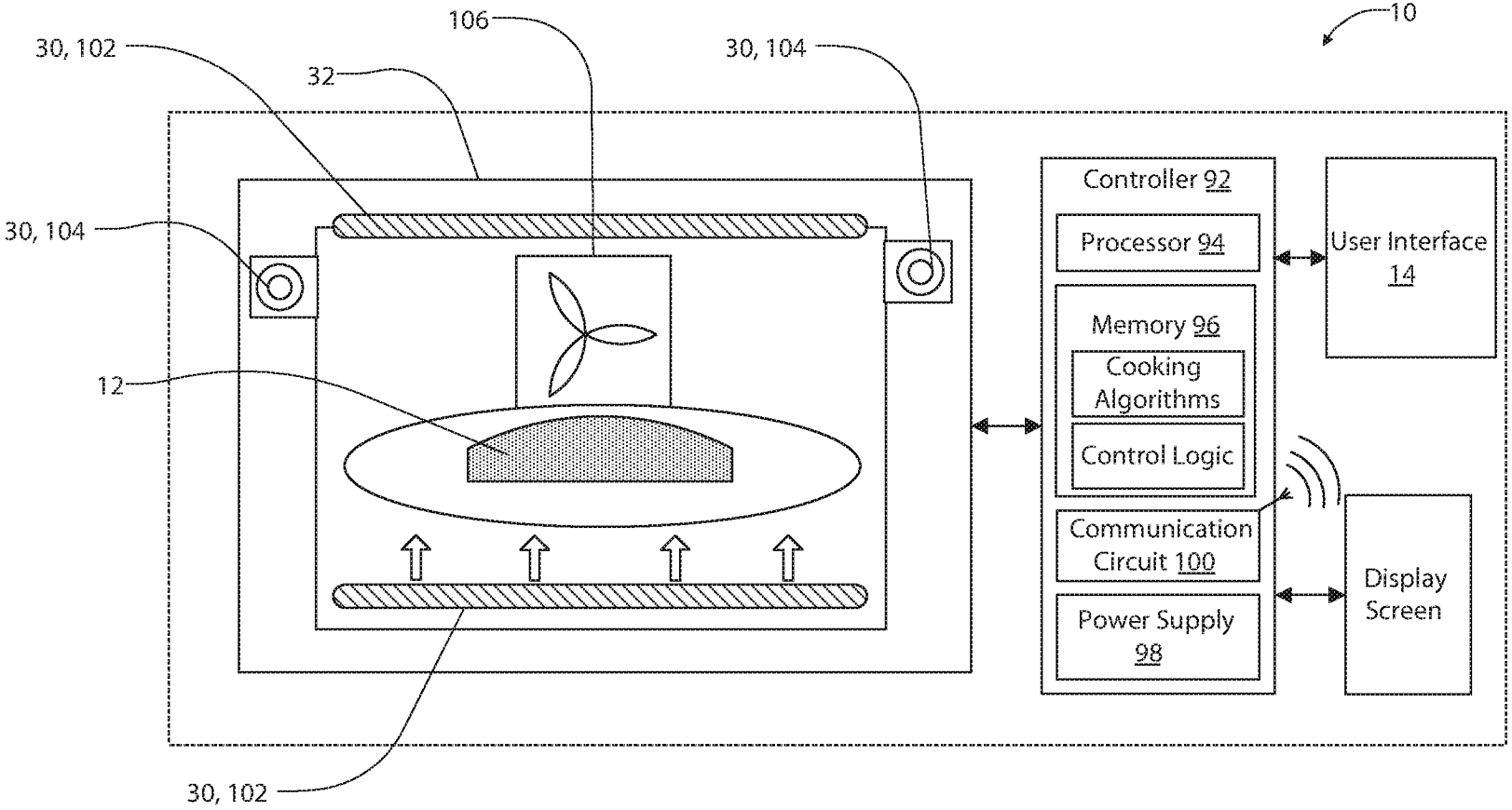
FIG. 4 is a block diagram of a cooking system in accordance with the disclosure.

Referring now to FIG. 4, a block diagram of the cooking system 10 is shown. As previously discussed, the cooking system 10 may comprise a controller 92, which may be configured to control the cooking apparatus 12. The controller may comprise a processor 94 and a memory 96. The processor 94 may correspond to one or more circuits and/or processors configured to communicate with the user interface 14 and access the properties of a selected food type via the memory 96 such that a numerical model may be generated for the model 16. In this configuration, the controller 92 may be operable to generate the heating or cooking routine for the at least one heat source 30 of the heating apparatus 32. The properties of the each of the layers 20 for the food types stored in the memory 96 may include a wide variety of properties including a heat transfer coefficient, density, thermal capacity, thermal diffusivity as well as electromagnetic permittivity, reflection coefficient, IR absorption coefficient, and various additional properties. Additionally, the memory 96 may comprise instructions for a variety of scaling and/or arithmetic operations that may be configured to resolve the numerical model of the food load 12 based on a proportion of a specified food type.

The controller 92 may be supplied electrical current by a power supply 98 and may further comprise a communication circuit 100. The communication circuit 100 may correspond to various wired and/or wireless communication devices through which the controller 92 may communicate and/or access information stored in a remote server or location. For example, the communication circuit 100 may correspond to a local area network interface and/or a wireless communication interface. The wireless communication interface may be configured to communicate through various communication protocols including but not limited to wireless 3G, 4G, Wi-Fi®, Wi-Max®, CDMA, GSM, and/or any suitable wireless communication protocol. In this configuration, the controller 92 of the cooking system 10 may be configured to access information (e.g. properties of the layers 20) for a wide variety of food types.

The heating apparatus 32 may comprise various forms of heat sources 30 including, but not limited to a browning or heating element 102, a microwave element 104, a convection fan 106, or any mechanism suitable to heat food as discussed herein. The browning or heating element 102 may correspond to a gas burner, an electrically resistive heating element, an induction heating element, a browning or ferritic heating element or any other suitable heating device. Depending on the specific parameters of the layers 20, the controller 92 may selectively and independently control one or more of the heat sources 30 such that each of the layers 20 of the food load 12 is prepared to a desired parameter.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooking system configured to heat a food load comprising:

a heating cavity comprising a heating apparatus;

a user interface configured to receive a user input defining the selected food; and a controller in communication with the heating apparatus and the user interface, the controller configured to:

access a cooking model for the selected food, wherein the cooking model comprises a first layer indicating a first heat absorption relationship and a second layer indicating a second heat absorption relationship;

receive a first cooking parameter from the user interface for the first layer;

receive a second cooking parameter from the user interface for the second layer;

calculate a heat exchange model based on the first heat absorption relationship and the second heat absorption relationship; and control the heating apparatus based on the heat exchange model thereby heating the food load such that the first layer conforms to the first cooking parameter and the second layer conforms to the second cooking parameter.

2. The cooking system according to claim 1, wherein the model corresponds to a segmented model simulating the first layer and the second layer of the food load as segmented layers.

3. The cooking system according to claim 1, wherein the first heat absorption relationship corresponds to an interaction between the first layer and the heating apparatus through the heating cavity and a conductive interaction between the second layer and the first layer.

4. The cooking system according to claim 1, wherein the second heat absorption relationship corresponds to an interaction between the second layer and the heating apparatus through the heating cavity and a conductive interaction between the first layer and the second layer.

5. The cooking system according to claim 1, wherein the cooking model for the selected food further comprises a third layer indicating a third heat absorption relationship.

6. The cooking system according to claim 5, wherein the second heat absorption relationship further corresponds to an interaction between the second layer and the third layer.

7. The cooking system according to claim 1, wherein the heating apparatus comprises a plurality of heat sources.

8. The cooking system according to claim 7, wherein the controller is configured to control each of the heat sources to vary the heat transfer to the first layer and the second layer.

9. The cooking system according to claim 7, wherein a first heat source of the plurality of heat sources is configured to generate a high intensity heat configured to brown the first layer.

10. The cooking system according to claim 9, wherein a second heat source of the plurality of heat sources is configured to generate a low intensity heat configured to heat the second layer.

11. A method for heating each of a plurality of layers of a food load to a desired cooking parameter comprising:

receiving an indication of a selected food type;

accessing a model for the selected food type, wherein the model comprises a first layer indicating a first heat absorption relationship and a second layer indicating a second heat absorption relationship;

receiving a first input indicating a first cooking parameter of the first layer;

receiving a second input indicating a second cooking parameter of the second layer;

calculating a heat exchange model based on the first heat absorption relationship and the second heat absorption relationship; and heating the food load by activating a plurality of heat sources, wherein the heat sources are selectively activated to supply heat according to the heat exchange model thereby heating the food load such that the first layer conforms to the first cooking parameter and the second layer conforms to the second cooking parameter.

12. The method according to claim 11, wherein the first cooking parameter corresponds to a browning level.

13. The method according to claim 12, wherein the second cooking parameter corresponds to a temperature level.

14. The method according to claim 11, further comprising:

receiving a third input indicating a third cooking parameter of a third layer of the model.

15. The method according to claim 14, wherein the heat exchange model is further calculated based on a third absorption relationship between the second layer and the third layer.

16. The method according to claim 11, wherein the heating the food load by activating the plurality of heat sources comprises selectively activating a first heat source corresponding to an electrically resistive heating element and a second heat source corresponding to a microwave heat source.

17. A cooking system configured to heat each of a plurality of layers of a food load to a desired cooking parameter comprising:

a heating cavity comprising a plurality of heat sources;

a user interface configured to receive a user input; and a controller in communication with the heating apparatus and the user interface, the controller configured to:

receive an indication of a selected food type from the user interface;

access a model for the selected food type, wherein the model comprises:

a first layer indicating a first heat absorption relationship, a second layer indicating a second heat absorption relationship, and a third layer indicating a third heat absorption relationship;

receive at least one cooking parameter for each of the first layer, the second layer, and the third layer;

calculate a heat exchange model based on the cooking parameters; and selectively activate each of the plurality of heat sources to prepare the food load such that each of the first layer, the second layer, and the third layer conform to the at least one cooking parameter received.

18. The cooking system according to claim 17, wherein the controller is configured to calculate a duty cycle of each of the heat sources to control the heat transfer into each of the plurality of layers.

19. The cooking system according to claim 17, wherein the at least cooking parameter of the first layer corresponds to a browning level.

20. The cooking system according to claim 17, wherein the at least one cooking parameter of the third layer corresponds to a moisture level.

* * * * *